United States Patent [19]

Baba

[11] Patent Number: 4,461,206

[45] Date of Patent: Jul. 24, 1984

[54] CROWN STRUCTURE FOR A THREE-PILLAR TYPE PRESS

[75] Inventor: Kiyokazu Baba, Komatsu, Japan

[73] Assignee: Kabushiki Kaisha Komatsu Seisakusho, Tokyo, Japan

[21] Appl. No.: 418,035

[22] Filed: Sep. 14, 1982

[51] Int. Cl.[3] ..... B30B 7/00

[52] U.S. Cl. ..... 100/208

[58] Field of Search ..... 100/193, 208, 207, 282; 83/618; 72/404, 405, 407, 408

[56] References Cited

U.S. PATENT DOCUMENTS 3,779,155 12/1973 Ohno ..... 100/282 X

*Primary Examiner*—Billy J. Wilhite

*Attorney, Agent, or Firm*—Armstrong, Nikaido, Marmelstein & Kubovcik

[57] ABSTRACT

A segmented crown structure for a three-pillar type press having a right and a left slide each suspended from the crown structure at four points. The crown structure is divided into central, right and left crowns. The central crown includes a motor for driving the press and a main shaft driven by the motor through a gear train. Also included in the central crown are four main gears driven by the main shaft through gear engagement. The right crown includes a shaft connected to the main shaft with a coupling and two main gears. Similarly the left crown includes a shaft connected to the main shaft with a coupling and two main gears. The two main gears in the right crown and two main gears in the central crown sided on the right suspend the right slide through four connection rods. Similarly the two main gears in the left crown and two main gears in the central crown sided on the left suspend the left slide through four connection rods.

2 Claims, 3 Drawing Figures

CROWN STRUCTURE FOR A THREE-PILLAR TYPE PRESS

BACKGROUND OF THE INVENTION

This invention relates to a structure of a crown for three-pillar type presses.

The three-pillar type presses are generally large-sized and the gear trains installed in their crowns are complicated and the number of gears are large. For example, in a known press, the number of gear teeth from its clutch and brake shaft to its main gears was as many as 27 resulting in increased noise level and increased cost of the crown structure itself.

SUMMARY OF THE INVENTION

It is therefore an object of the present invention to provide a segmented crown structure for a three-pillar type press which is simple in construction having far less number of gears therein for power transmission.

Another object of the present invention is to provide a segmented crown structure for a three-pillar type press which can significantly reduce noise level generated by gears in the crown structure.

A further object of the present invention is to provide a segmented crown structure for a three-pillar type press which can be adopted for a wide crown type press without changing a gear train used therein.

In accordance with an aspect of the present invention, there is provided a segmented crown structure for a three-pillar type press having a first and a second slide, comprising: a central crown including a central crown frame; drive means mounted on said central crown frame; first shaft means connected to and driven by said drive means, said first shaft means having a first gear fixedly mounted thereon; second shaft means rotatably mounted on said central crown frame, said second shaft means having second, third and fourth gears fixedly mounted thereon with said second gear being in mesh with said first gear; first, second, third and fourth main gears rotatably mounted on said central crown frame with said first and second main gears being in mesh with said third gear and said third and fourth main gears being in mesh with said fourth gear, respectively; first and second connection rods each having one end connected to said first or second main gear and the other end connected to said first slide; and third and fourth connection rods each having one end connected to said third or fourth main gear and the other end connected to said second slide; a left crown including a left crown frame; third shaft means rotatably mounted on said left crown frame, said third shaft means having a fifth gear fixedly mounted thereon; fifth and sixth main gears rotatably mounted on said left crown frame and being in mesh with said fifth gear; and fifth and sixth connection rods each having one end connected to said fifth or sixth main gear and the other end connected to said first slide; first coupling means for coupling said second shaft means with said third shaft means; a right crown including a right crown frame; fourth shaft means rotatably mounted on said right crown frame, said fourth shaft means having a sixth gear fixedly mounted thereon; seventh and eighth main gears rotatably mounted on said right crown frame and being in mesh with said sixth gear; and seventh and eighth connection rods each having one end connected to said seventh or eighth main gear and the other end connected to said second slide; and second coupling means for coupling said second shaft means with said fourth shaft means.

The above and other objects, features and advantages of the present invention will be readily apparent from the following description taken in conjunction with the accompanying drawings.

DESCRIPTION OF THE PREFERRED EMBODIMENT

Figure 1:
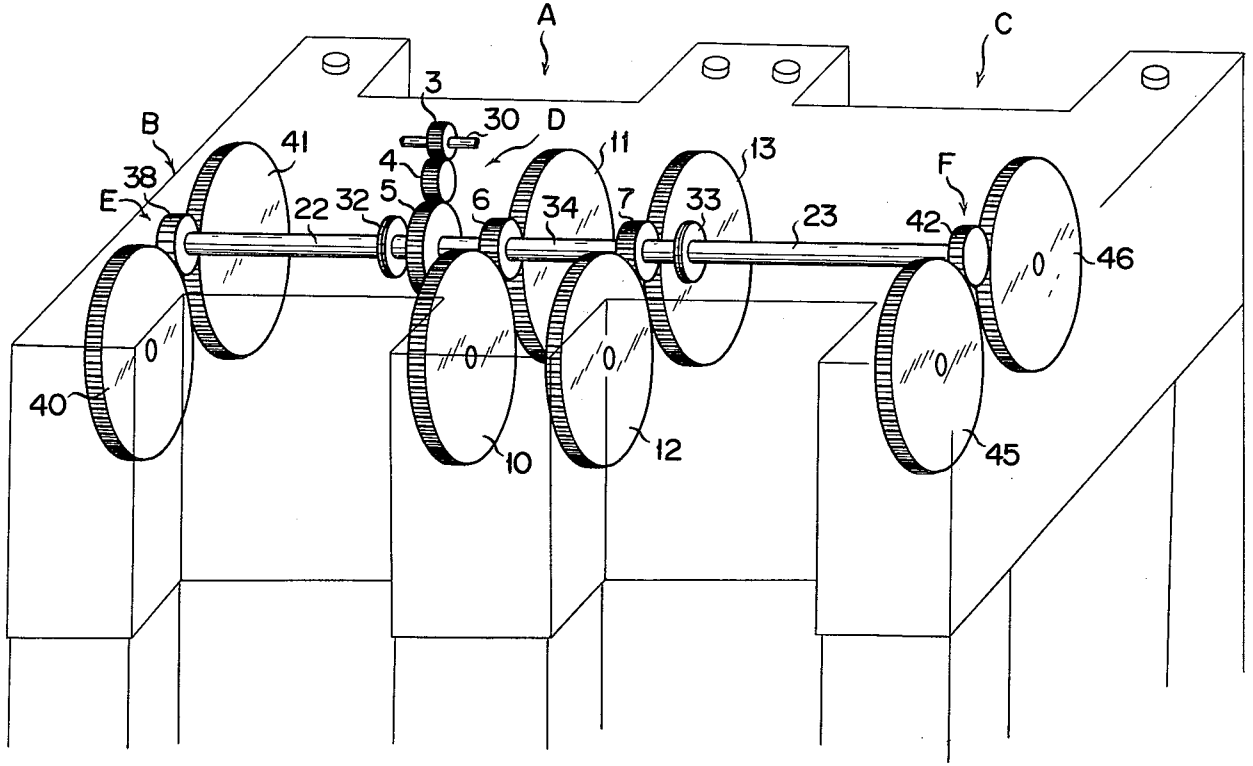
FIG. 1 is a schematic perspective view of a crown structure of the present invention, with parts being omitted for clarity, showing a gear train employed therein.
Figure 2:
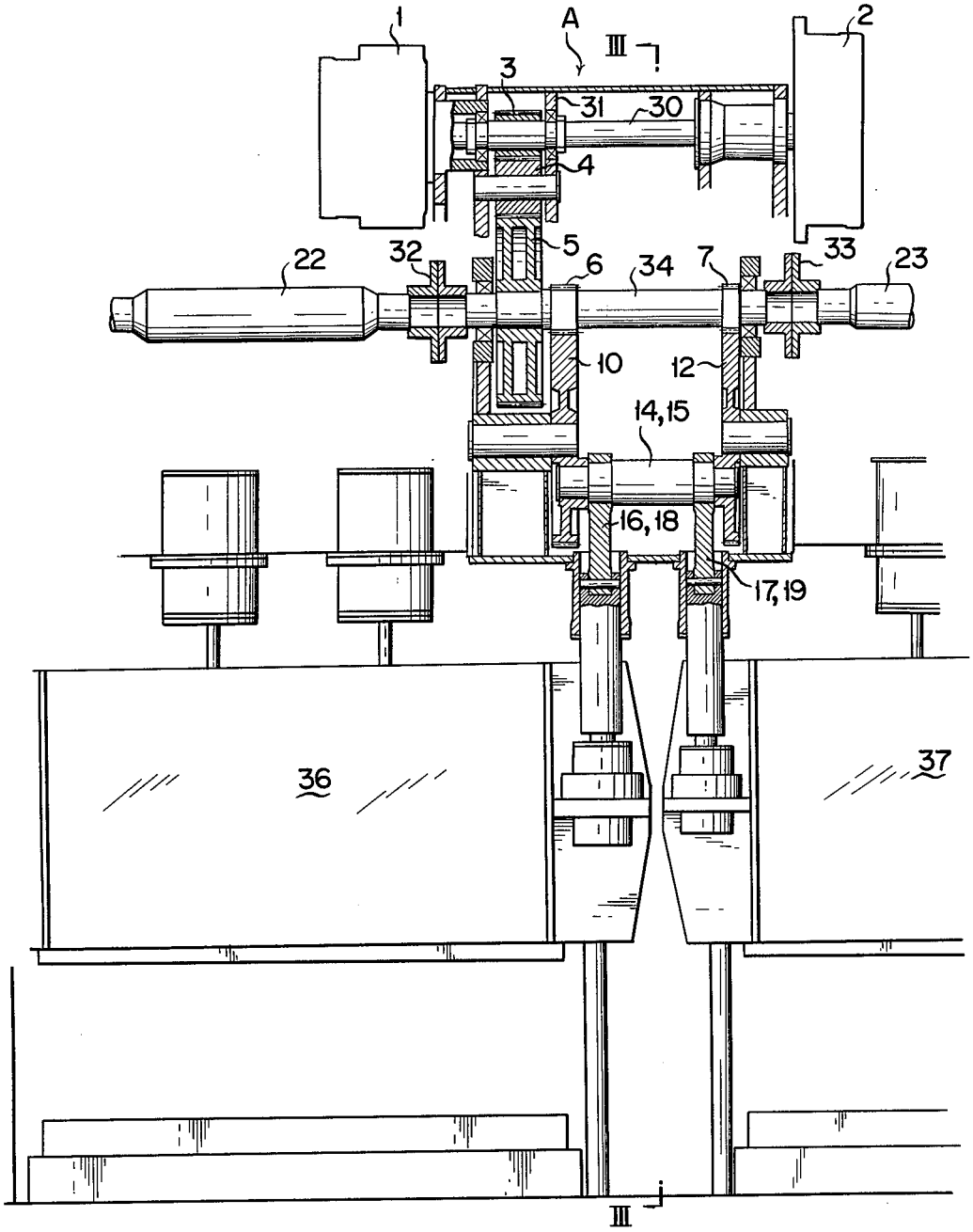
FIG. 2 is a longitudinal sectional view of a central crown structure according to the present invention.
Figure 3:
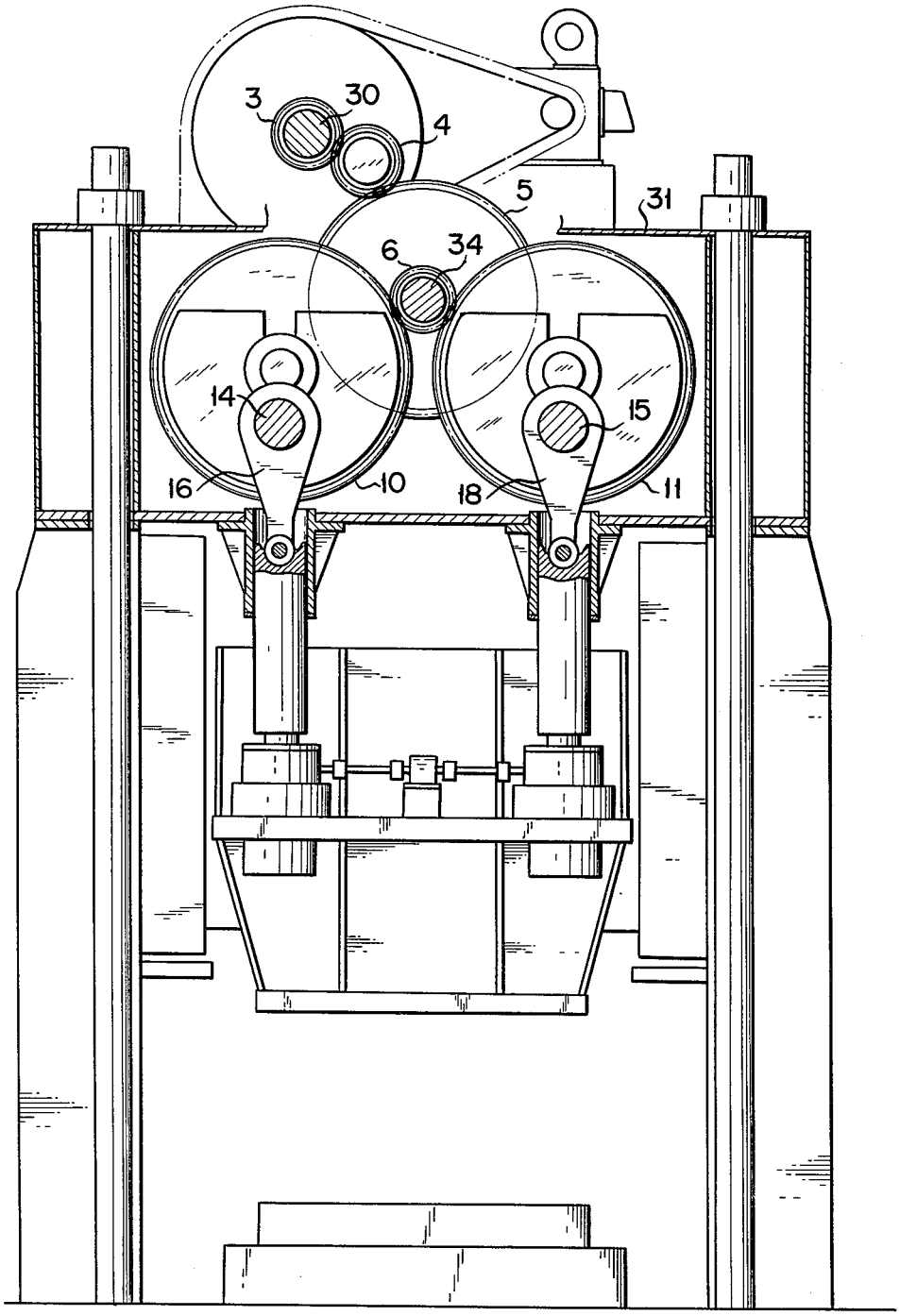
FIG. 3 is a sectional view of the central crown taken along the line III—III of FIG. 2.

The present invention will now be described below with reference to the accompanying drawings.

In the drawings, reference character "A" denotes a central crown, "B" a left crown and "C" a right crown. The central crown "A" includes a press driving unit "D" which comprises a first shaft 30 connected to the output side of a clutch 1, the first shaft 30 being also connected to a brake 2. The first shaft 30 has a first gear 3 fixedly secured thereto. This first shaft 30 is rotatably carried by a frame 31. The frame 31 rotatably carries shaft 22 and 23. The shafts 22 and 23 are connected through couplings 32 and 33 at their ends to a second shaft 34. The second shaft 34 has a second gear 5, a third gear 6 and a fourth gear 7 fixedly secured thereto. The second gear 5 meshes with idler gear 4 which in turn meshes with the first gear 3.

Two pairs of main gears 10, 11 and 12, 13 are rotatably carried by the frame 31. The pairs of main gears 10, 11 and 12, 13 mesh with the third gear 6 and the fourth gear 7, respectively.

The main gears 10, 12 have a pin 14 fixedly secured thereto, and the main gears 11, 13 have a pin 15 fixedly secured thereto. The pin 14 has connection rods 16, 17 connected thereto, and the pin 15 has connection rods 18, 19 connected thereto. The connection rods 16, 18 are connected to a slide 36, whilst the connection rods 17, 19 are connected to a slide 37.

The left crown "B" includes a driving unit "E" which has a fifth gear 38 connected to the aforementioned shaft 22. The fifth gear 38 meshes with main gears 40 and 41. Connection rods (not shown) are connected at their upper ends to pins which are fixedly secured to the main gears 40, 41 and are connected at their lower ends to the slide 36.

The right crown "C" includes a driving unit "F" which has a sixth gear 42 connected to the aforementioned shaft 23. The sixth gear 42 meshes with main gears 45 and 46. Connection rods (not shown) are connected at their upper ends to pins which are fixedly secured to the main gears 45, 46 and are connected at their lower ends to the slide 37.

The operation of the present invention will now be described below.

The power derived from a main motor (not shown) is transmitted through the clutch 1 to the first shaft 30 and then transmitted in turn to the first gear 3, the idler gear 4, the second gear 5, the second shaft 34, the third gear 6 and the fourth gear 7 thereby to rotate or drive the main gears 10, 11 and 12, 13. The rotation of the main gears 10, 12 will transmit the power to the connection rods 16, 17. The rotation of the main gears 11, 13 will transmit the power to the connection rods 18, 19.

Although, in the foregoing, the structure and movement of the central crown have been described, the transmission of the power to the left crown "B" is made in the similar manner through the couplings 32, 33 so that the driving units "E" and "F" may be driven to actuate the slides 36 and 37 together with driving of the press driving unit "D" of the central crown "A".

The number of gears of the crown structure according to the present invention is 15.

Since the crown structure of the present invention is constructed as mentioned in detail hereinabove, it is possible not only to reduce the number of the gears from that of the prior art structure to reduce the noise generated thereby, but also to reduce the cost thereof, and the present invention can be applied even to the wide crowns without altering their gear trains.

What is claimed is:

1. A segmented crown structure for a three-pillar type press having a first and second slide, comprising:

a central crown including a central crown frame; drive means mounted on said central crown frame; first shaft means connected to and driven by said drive means, said first shaft having a first gear fixedly mounted thereon; second shaft means rotatably mounted on said central crown frame, said second shaft means having second, third and fourth gears fixedly mounted thereon with said second gear being operatively connected with said first gear; first, second, third and fourth main gears rotatably mounted on said central crown frame with said first and second main gears being in mesh with said third gear and said third and fourth main gears being in mesh with said fourth gear, respectively; first and second connection rods each having one end connected to said first and second main gears respectively, and the other ends connected to said first slide; and third and fourth connection rods each having one end connected to said third and fourth main gears respectively, and the other ends connected to said second slide;

a left crown including a left crown frame; third shaft means rotatably mounted on said left crown frame, said third shaft means having a fifth gear fixedly mounted thereon; fifth and sixth main gears rotatably mounted on said left crown frame and being in mesh with said fifth gear; and fifth and sixth connection rods each having one end connected to said fifth and sixth main gears respectively, and the other ends connected to said first slide;

first coupling means for coupling said second shaft means with said third shaft means;

a right crown including a right crown frame; fourth shaft means rotatably mounted on said right crown frame, said fourth shaft means having a sixth gear fixedly mounted thereon; seventh and eighth main gears rotatably mounted on said right crown frame and being in mesh with said sixth gear; and seventh and eighth connection rods each having one end connected to said seventh and eighth main gears respectively, and the other ends connected to said second slide; and second coupling means for coupling said second shaft means with said fourth shaft means.

2. A segmented crown structure as recited in claim 1 further comprising first pin means having one end mounted to said first main gear and the other end mounted to said third main gear, and second pin means having one end mounted to said second main gear and the other end mounted to said fourth main gear and wherein the one ends of said first and third connection rods are connected to said first pin means and said one ends of said second and fourth connection rods are connected to said second pin means.

* * * * *